United States Patent [19]

Loomis et al.

[11] Patent Number: 4,655,721

[45] Date of Patent: Apr. 7, 1987

[54] TOY CONSTRUCTION WITH LIGHT EMITTING ELEMENT

[75] Inventors: Bernard Loomis, New York; Vincent A. Baiera, Brooklyn; Bennie J. Caldwell, Hempstead; Gary J. Strauss, Mamaroneck, all of N.Y.

[73] Assignee: Hasbro Bradley, Inc., Pawtucket, R.I.

[21] Appl. No.: 710,056

[22] Filed: Mar. 11, 1985

[51] Int. Cl.[4] ..... A63H 33/22

[52] U.S. Cl. ..... 446/219; 446/392

[58] Field of Search ..... 446/219, 392, 389, 343, 446/485; 362/32; 250/458.1

[56] References Cited

U.S. PATENT DOCUMENTS

| | | | |
|---|---|---|---|
| 2,933,853 | 4/1960 | Laval, Jr. | 446/485 X |
| 3,181,271 | 5/1965 | Withams | 446/219 |
| 3,634,678 | 1/1972 | Glass et al. | 362/32 |
| 3,934,148 | 1/1976 | Collins | 250/458.1 |
| 4,097,917 | 6/1978 | McCaslin | 362/32 |

*Primary Examiner*—Mickey Yu

*Attorney, Agent, or Firm*—Salter & Michaelson

[57] ABSTRACT

A toy construction having a light element which can be illuminated without the use of an artificial light source in the toy. The toy comprises a toy body made of an opaque material and having an aperture therethrough, and a light element made of a translucent material having a fluorescent color. The light element is mounted on the toy body and it includes a collecting portion having an enlarged, preferably smooth, collecting surface thereon which is located in an exposed position on the exterior of the toy and an emitting portion having a reduced, preferably roughened, emitting surface thereon which is also located in an exposed position on the exterior of the toy. The light element communicates with the exterior of the toy body through the aperture in the toy body so that the emitting and collecting surfaces are exposed at spaced locations on the toy and when the collecting surface is exposed to an external light source, light is transmitted through the light element so that the emitting surface exhibits a glowing effect.

1 Claim, 4 Drawing Figures

TOY CONSTRUCTION WITH LIGHT EMITTING ELEMENT

BACKGROUND AND SUMMARY OF THE INVENTION

The instant invention relates to toys and more particularly to a toy construction wherein certain elements of the toy can be illuminated by exposing other portions thereof to an external light source.

It is generally recognized that often the play value of a toy can be substantially enhanced by the addition of elements thereto which can be illuminated when desired. For example, the play value of a toy monster can be enhanced by providing eyes thereon which can be illuminated to give the monster a more realistic and terrifying appearance. Similarly, illuminated tail lights and head lights can impart a more realistic appearance to a toy vehicle and thereby enhance the play value of the vehicle. Unfortunately, however, in order to provide illuminated elements in a toy construction, heretofore it has generally been necessary to include an artificial light source in the toy comprising one or more batteries and a light bulb. While, the addition of a light source to a toy can enhance the play value of the toy, unfortunately it generally also substantially increases the cost of the toy and it also means that the batteries must be periodically replaced by a user of the toy in order to maintain the light source in an operative condition. Both of these factors have tended to reduce the desirability of some toys having light sources therein, particularly those toys which would otherwise be adapted for relatively inexpensive constructions. Hence, although it has long been recognized that the addition of elements to a toy, which can be illuminated when desired, can substantially enhance the play value of the toy, in many cases it has not been practical to add elements of this type to otherwise simple and inexpensive toys.

While the use of light transmitting elements, such as fiber optic elements, in toys and other devices has been generally known for a number of years, most of the known toys which have included light transmitting elements have also included artificial light sources therein for supplying light to the light transmitting elements thereof. It has now been found that a new type of light element can be effectively used in toys and other devices for providing illuminated elements therein without the use of internal light sources. In particular, it has been found that when materials such as plastics which are both translucent and fluorescent are formed to provide light elements having enlarged collecting portions and reduced emitting portions, these light elements can be effectively utilized to provide illuminated elements in toys and other devices without requiring internal light sources in the toys. More specifically, when a light element of this type is mounted in a substantially opaque body of a toy or other device so that the collecting portion of the light element can be exposed to an external light source, and so that the emitting portion of the light element communicates with the exterior of the toy body through an aperture in the toy body to make the collecting and emitting portions of the light element visible at spaced locations on the exterior of the body of the toy or other device, light which falls on the collecting portion is internally transmitted to the emitting portion to illuminate the emitting portion, even when it is shaded from the external light source. In this regard, it has been found that light elements made of materials which are both translucent and fluorescent, i.e. translucent materials having fluorescent colors, exhibit a "glowing effect" when they are exposed to an external light source and it has also been found that this glowing effect is particularly pronounced in the portions of the light elements having reduced surface areas, such as the edge surface portions of a light element defined by a sheet of translucent fluorescent material. It has further been found that this phenomenon can be taken advantage of when a light element made of a translucent fluorescent material is constructed so that it has both collecting and emitting portions, wherein the collecting surface of the collecting portion has a substantially greater area than the exposed emitting surface of the emitting portion. It has also been found that the glowing effect exhibited by a light element constructed from a translucent fluorescent material is particularly pronounced in areas of the light element having at least slightly roughened surface characteristics. Hence, by providing a roughened emitting surface on the emitting portion of a light element, the illuminating or glowing effect which is observed when the collection portion of the light element is exposed to a light source is even further enhanced.

The instant invention provides a novel toy comprising one or more light elements wherein the light elements can be effectively illuminated without requiring that an artificial light source be included in the toy. Hence, the instant invention also provides an effective toy construction wherein one or more light elements can be illuminated, but wherein the toy can nevertheless be embodied in relatively inexpensive constructions. The toy construction of the instant invention comprises a toy body made of an opaque material and having an aperture therein, and a light element on the toy body, the light element being made of a translucent material having a fluorescent color and comprising a collecting portion having a collecting surface thereon which is located in an exposed position on the exterior of the toy and an emitting portion which integrally extends from the collecting portion and has an emitting surface thereon, the emitting surface being located in an exposed position on the exterior of the toy which is spaced from the collecting surface. The collecting surface has a substantially greater area than the emitting surface and the light element is mounted on the toy body so that the emitting portion communicates with the exterior of the toy through the aperture therein whereby the emitting and collecting surfaces are located in spaced positions on the exterior of the toy body. The collecting portion is preferably disposed on the upper portion of the toy body and the collecting surface preferably faces at least partially upwardly for receiving light from an external light source located above the toy, whereas the emitting portion is preferably disposed in a recessed socket in the toy body which is disposed in a location which is spaced from the collecting surface and preferably at least partially shaded from the light source. The toy of the instant invention can be effectively embodied as a toy doll character, such as a human-like monster character and hence in this case the toy body is embodied as a human-like monster doll body. The collecting portion is preferably disposed on the upper rear portion of the doll body, for example on the upper rear head portion thereof, and a pair of emitting portions are preferably provided in the light element, the emitting portions communicating with the exterior of the toy through apertures in the head portion of the doll body for defining a pair of eyes therein which are illuminated when the collecting portion is exposed to an external light source. Accordingly, the instant invention provides a unique and interesting doll construction, wherein the eyes of the doll are illuminated when the doll is exposed to a light source. When the doll construction is formed in the configuration of a monster character or the like, the collecting portion is preferably embodied as the exposed brain of the character on the rear portion of the character's head, although in other embodiments of the toy, it is contemplated that the collecting portion could be embodied as a helmet worn on the head of a doll or as clothing worn by a doll. In any event, by providing a light element having a collecting portion which is positioned on the rear portion of a doll and a pair of emitting portions which define a pair of eyes on the doll, an unusual character having illuminated eyes can be produced without including an artificial light source in the doll. It will also be understood that the concept of the instant invention can be applied to provide various other types of glowing elements on doll characters and the like, such as glowing nostrils, mouths, hearts or inanimate elements such as logos, medallions, visors, binoculars, and weapons, and that the concept of the instant invention can also be embodied in various other types of toys, including toy vehicles and toy weapons. Further, it will be understood that the general concept of the instant invention can also be applied to provide illuminated elements in a variety of other types of devices and structures too numerous to mention.

Devices representing the closest prior art to the instant invention of which the applicant is aware are disclosed in the U.S. patents to REVEKA, U.S. Pat. No. 2,883,796; LAVAL, JR., U.S. Pat. No. 2,933,853; GLASS, U.S. Pat. No. 3,634,678; and NIEMI, U.S. Pat. No. 4,152,752. However, since these patents do not suggest a device which may be constructed so that it does not include an artificial light source, but which includes a light element comprising an emitting portion having an emitting surface thereon and a collecting portion having a collecting surface thereon, wherein the collecting surface is of substantially greater dimension than the emitting surface, and wherein the light element is made of a material which is both translucent and fluorescent, they are believed to be of only general interest.

Accordingly, it is a primary object of the instant invention to provide a toy construction which does not necessarily include an artificial light source therein, but wherein one or more light elements of the toy can nevertheless be illuminated when desired.

Another object of the instant invention is to provide a toy doll having eyes which can be illuminated by exposing the doll to an external light source.

Another object of the instant invention is to provide a toy construction comprising an opaque toy body having an aperture therethrough and a light element made of a material which is both translucent and fluorescent, the light element comprising a collecting portion having a collecting surface thereon which is located in an exposed position on the exterior surface of the toy, and an emitting portion which communicates with the exterior of the toy through the aperture and has an exposed emitting surface thereon which is spaced from the collecting surface, wherein light which is received by the collecting portion is transmitted to the emitting portion to illuminate the emitting portion.

Another object of the instant invention is to provide a simple and inexpensive means for providing an illuminated element in a toy construction.

Other objects, features and advantages of the invention shall become apparent as the description thereof proceeds when considered in connection with the accompanying illustrative drawings.

DESCRIPTION OF THE DRAWINGS

In the drawing which illustrates the best mode presently contemplated for carrying out the present invention.

DESCRIPTION OF THE INVENTION

Figure 1:
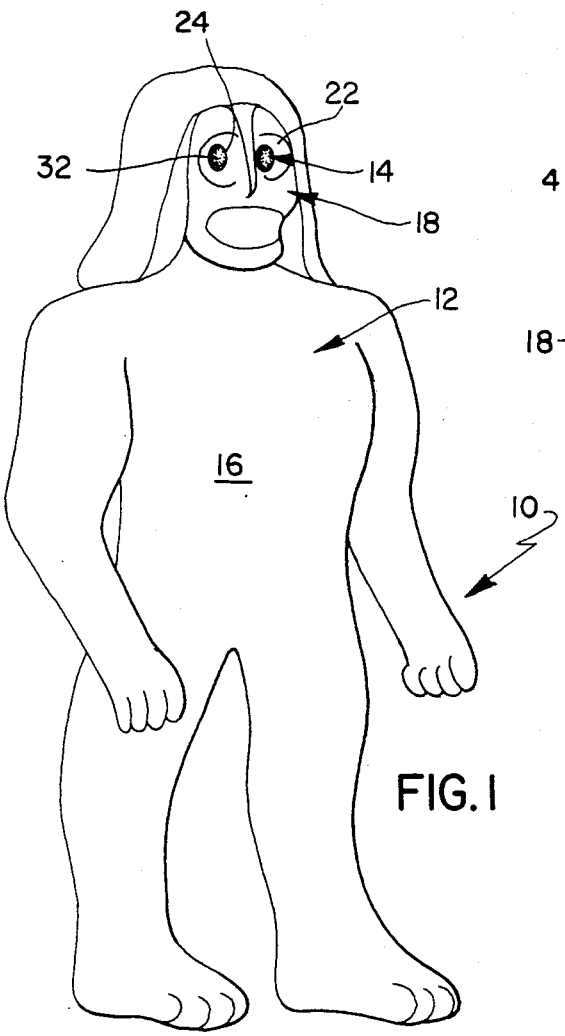
FIG. 1 is a perspective view of the toy of the instant invention.

Referring now to the drawing, the toy of the instant invention is illustrated and generally indicated at 10 in FIG. 1. The toy 10 is embodied as a doll construction which is configured to resemble a man-like monster character and it comprises a body portion generally indicated at 12 and a light element generally indicated at 14, the light element being more clearly illustrated in FIGS. 2–4. The light element 14 defines a pair of eyes on the face of the character embodied in the toy 10, as well as an exposed portion of the character's brain and it is operative for receiving light from an external light source and for transmitting it to the portions of the light element 14 which define the eyes of the character figure, as will hereinafter be more fully described. Hence, when the light element 14 is exposed to an external light source, the eyes of the doll character exhibit a glowing effect, which substantially enhances the play value of the toy 10.

Figure 2:
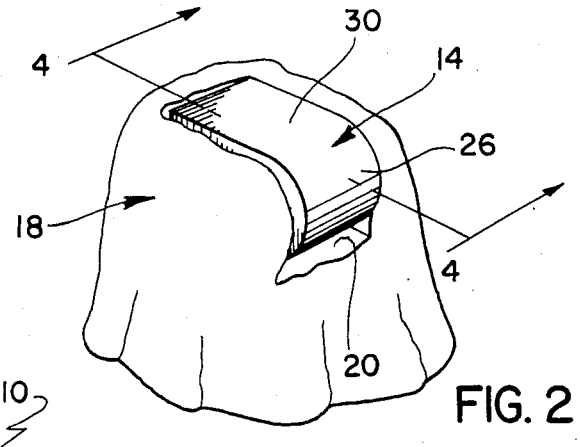
FIG. 2 is an enlarged rear perspective view of the head portion of the toy.
Figure 3:
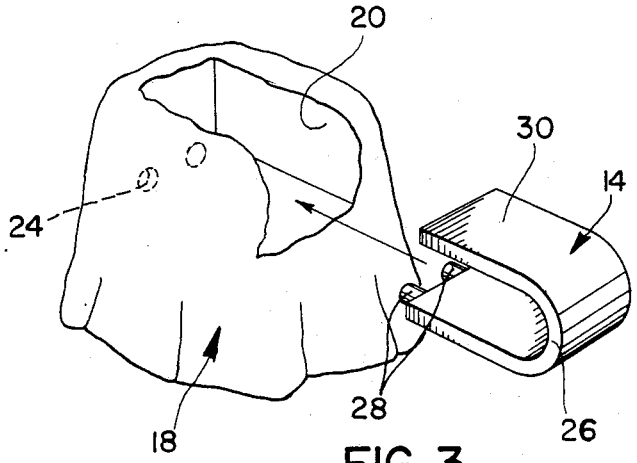
FIG. 3 is an exploded perspective view of the head portion.
Figure 4:
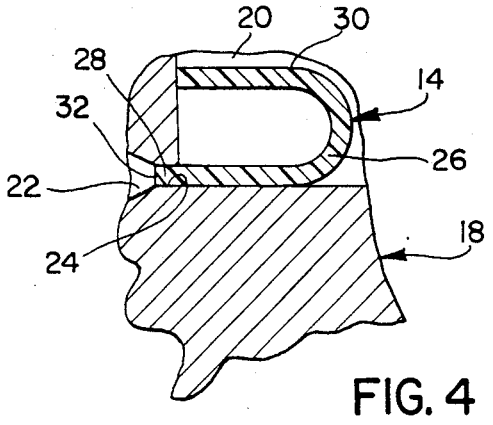
FIG. 4 is a sectional view taken along line 4—4 in FIG. 2.

The body 12 is configured to resemble a man-like monster figure as illustrated in FIG. 1, and it includes a main body portion 16 and a head portion 18. In this regard it will be understood, that other embodiments of the instant invention are contemplated, comprising bodies which are configured to resemble other character figures or even inanimate objects. In any event, in the toy 10, the body 12 defines a human-like monster character having the main body portion 16 and the head portion 18, which are constructed of an opaque material, such as a suitable opaque plastic material. The head portion 18 which is most clearly illustrated in FIGS. 2–4, is formed in the general configuration of the head of a man-like monster character and it has an open cavity 20 in the upper rear portion thereof. A pair of recessed eye sockets 22 are formed in the front facial portion of the head portion 18 and a pair of apertures 24 extend from the sockets 22 to the cavity 20.

The light element 14 is most clearly illustrated in FIGS. 2–4, and it comprises a collecting portion 26 and a pair of emitting portions 28 which integrally extend from the collecting portion 26. The light element 14 is made of a material which is both translucent and fluorescent, i.e. it is made of a translucent material having a fluorescent color, such as fluorescent red, orange, green, or yellow. The collecting portion is formed in a generally U-shaped configuration and it is received in the cavity 20. The collecting portion 26 has a substantially smooth collecting surface 30 thereon which is located in an exposed position on the toy 10 when the light element 14 is assembled on the body 12. More specifically, the collecting surface 30 is located adjacent the upper rear surface portion of the head portion 18, as illustrated in FIGS. 2 and 4 so that it can receive light from an external light source which is located generally above the toy 10, and so that it has the appearance of an exposed portion of the brain of the character embodied in the toy 10. The emitting portions 28 are preferably formed in reduced cylindrical configurations and they extend integrally forwardly from the collecting portion 26. The emitting portions 28 are received in the apertures 24 and they terminate in emitting surfaces 32 which are located adjacent the inner extremities of the sockets 22 and which preferably have at least slightly roughened surface characteristics. Accordingly, the emitting surfaces 32 are preferably located in areas of the head portion 18 which are spaced from the exposed collecting surface 30 and which are at least slightly shaded from a light source located generally above the toy 10.

For use of the toy 10, the collecting surface 30 is exposed to a light source and light which falls on the collecting surface 30 is transmitted to the emitting surface 32 so that they exhibit a glowing effect. This effect is enhanced by the roughened surface characteristics of the emitting surfaces 32 which causes the surfaces 32 to glow to a greater extent than other smooth portions of the light element 14. This glowing effect is emphasized by the fact that the surfaces 32 are located in the recessed sockets 22 and hence, normally at least partially shaded from a light source located generally above the toy 10, so that the surfaces 32 do not normally receive substantial quantities of light directly therefrom. Further, because the collecting surface 30 has a substantially greater area than the combined area of the emitting surfaces 32, a sufficient amount of light can be collected by the collecting surface 30 to permit it to be effectively transmitted to the emitting surfaces 32 through the light element 14.

Accordingly, it is seen that the instant invention provides an effective toy construction which does not necessarily include an artificial light source, wherein certain portions of the toy can be effectively illuminated when other portions thereof are exposed to an external light source. More specifically, the emitting surfaces 32 which define the eyes of the character figure embodied in the toy 10 can be effectively illuminated to enhance the play value of the toy 10 when the collecting surface 30 is exposed to a light source. Further, because the toy 10 effectively collects and uses light from an external light source, it does not require the use of an internal artificial light source comprising batteries and a lightbulb and hence, it is adapted for relatively simple and inexpensive constructions. Accordingly, for these reasons as well as the other reasons hereinabove set forth, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy construction comprising:

a. a doll body including a head portion, said head portion having a recessed area in the upper rear portion thereof, having a forwardly facing facial portion, and having a pair of apertures which extend forwardly through said head portion from said recess to said facial portion to define a pair of recessed eye sockets therein; and b. a light element integrally made of a translucent fluorescent material and comprising a collecting portion having a collecting surface thereon and an emitting portion comprising a pair of emitting elements having emitting surfaces thereon, said collecting portion being disposed in said recessed area so that said collecting surface faces upwardly and rearwardly on said head portion when said head portion is in an upright disposition, said collecting surface being of substantially greater dimension than the combined dimension of said emitting surfaces, said emitting elements extending through said apertures and terminating in said emitting surfaces, said emitting surfaces facing forwardly in said eye sockets but being recessed therein to normally shade said emitting surfaces from a light source positioned above said toy.

* * * * *